US006871678B2

(12) United States Patent
Guszlovan

(10) Patent No.: US 6,871,678 B2
(45) Date of Patent: Mar. 29, 2005

(54) WINE BARREL FILLING APPARATUS

(76) Inventor: Jim Guszlovan, 39 Fordham Road., Reservoir, Victoria (AU), 3073

( * ) Notice: Subject to any disclaimer, the term of this patent is extended or adjusted under 35 U.S.C. 154(b) by 0 days.

(21) Appl. No.: 10/477,787

(22) PCT Filed: Mar. 20, 2002

(86) PCT No.: PCT/AU02/00340

§ 371 (c)(1),
(2), (4) Date: Nov. 13, 2003

(87) PCT Pub. No.: WO02/076876

PCT Pub. Date: Oct. 3, 2002

(65) Prior Publication Data

US 2004/0149345 A1 Aug. 5, 2004

(30) Foreign Application Priority Data

Mar. 22, 2001 (AU) ..... PR3903

(51) Int. Cl.[7] ..... B65B 1/30

(52) U.S. Cl. ..... 141/198; 141/96; 141/206; 141/301

(58) Field of Search ..... 141/94–96, 98, 141/192, 198, 206, 301, 302, 208, 392; 53/367

(56) References Cited

U.S. PATENT DOCUMENTS

| | | | | |
|---|---|---|---|---|
| 3,918,475 A | | 11/1975 | Trusselle | |
| 3,920,056 A | * | 11/1975 | Piecuch | 141/94 |
| 3,977,154 A | | 8/1976 | Kamisaka et al. | |
| 4,018,026 A | * | 4/1977 | Kamisaka et al. | 53/471 |

FOREIGN PATENT DOCUMENTS

| | | |
|---|---|---|
| EP | 215631 | 3/1987 |
| FR | 2775274 | 8/1999 |
| GB | 2108471 | 5/1983 |

* cited by examiner

*Primary Examiner*—Timothy L. Maust
(74) *Attorney, Agent, or Firm*—Haynes and Boone, LLP

(57) ABSTRACT

An apparatus (1) for filling a wine barrel is disclosed. The apparatus has a nozzle (4) connected to a hollow handle (15) where the upstream portion of the handle is connected to a hose from a wine supply. Supply of wine in the apparatus is controlled by a control button (17) on the handle (15) which opens an upstream solenoid valve. The apparatus (1) has a locating lug (6) and arm (7) on the nozzle portion to allow generally vertical location of the nozzle in a barrel bung hole. The apparatus has a non-return valve (14) to prevent wine flowing from the hose to the apparatus when the upstream solenoid valve is closed. The apparatus has a conductivity sensor (9) to cause closure of the upstream solenoid valve when the wine in the barrel reaches a predetermined level.

12 Claims, 1 Drawing Sheet

WINE BARREL FILLING APPARATUS

CROSS REFERENCE

This application is a national phase application and claims priority to international patent application number PCT/AU02/00340, filed Mar. 20, 2002, which claims priority to Australia application number PR 3903, filed Mar. 22, 2001.

TECHNICAL FIELD

This invention relates to an apparatus for filling wine barrels with wine.

BACKGROUND TO THE INVENTION

Timber barrels or casks are commonly used in the production of wine. The wine is usually aged in the barrel or cask and the ageing wine extracts soluble material from the timber that enhances the wine quality. The barrels are usually made from oak timber. Barrel sizes vary. Barriques, hogsheads, puncheons and other size variations are used at the wine makers discretion, depending on the requirements of the wine. The cost of barrels is relatively high and for French oak barrels can be up to $1,000 per barrel. Larger sized barrels would mean less surface area per liter of wine which would result in longer time being required for the wine to be aged in the barrel. A consequence of the desirable relatively small volume of the timber barrels used in the wine industry is that many barrels are required to be filled with wine. Large wineries may have thousands of such barrels.

The traditional method of filling a barrel with wine is for a hose to be connected to a bulk storage tank containing wine. The hose, of approximate internal diameter 25 mm, is manually inserted into a bung hole located in the top of the barrel. An operator opens a tap or valve located near the barrel end of the hose to allow wine to flow through the hose into the barrel. It is difficult to ascertain the level of wine in the barrel as it is being filled. Normally the operator uses a torch to sight the rising level viewed through the gap between the hose and the bung hole.

The operator adjusts the flow rate of wine until the barrel is filled. Apart from the initial filling of a barrel, the barrel is required to be topped up during the wine aging process. This topping up process involves a repeat of the initial filling process.

The filling process is both time consuming and labour intensive. It can also lead to spillage of wine and the lack of complete filling of barrels which is costly considering the high cost of the barrels.

Various apparatus have been proposed for filling vessels with liquids from a hose having a nozzle at the downstream end. Such apparatus are commonly used for filling motor vehicle fuel tanks. An example of such equipment is GB 2108 471A. However the apparatus of this citation while suitable for filling a motor car fuel tank does not have features to maintain the nozzles at a fixed vertical position that would be desirable when filling a wine barrel. For filling fuel tanks this is not necessary as the nozzle is retained in position by the neck of the fuel tank in a car.

This citation also does not have a valve means to prevent the flow of fuel to the nozzle when the upstream valve is closed as this is not necessary for filling a car fuel tank.

It would be desirable to have an apparatus for filling wine barrels that was easier to operate and more cost effective.

SUMMARY OF THE INVENTION

This invention provides in one form an apparatus for filling a wine barrel through a bung hole in the top of the barrel comprising: a nozzle; a means for locating the nozzle at a predetermined vertical position relative to the inner surface of the barrel adjacent the bung hole; an electronic wine level sensor means adapted to send a signal to an upstream wine flow control valve to regulate the wine flow into the barrel when the wine level reaches a predetermined level in the barrel; a valve located at the upstream end of the nozzle to prevent wine flowing into the nozzle from upstream of the valve when the upstream wine flow control valve is closed.

Preferably the electronic sensor means is an elongate probe that, in use, is positioned to be in contact with the wine in the barrel when the wine is at the predetermined level.

Preferably the electronic sensor means is a conductivity probe.

Preferably the apparatus further includes a nozzle extension adapted to reversibly engage onto the downstream nozzle end.

Preferably the apparatus further includes a hollow handle member connected to the upstream end of the nozzle.

The invention will be further described by reference to a preferred embodiment illustrated in the drawing.

DETAILED DESCRIPTION OF THE INVENTION

Figure 1:
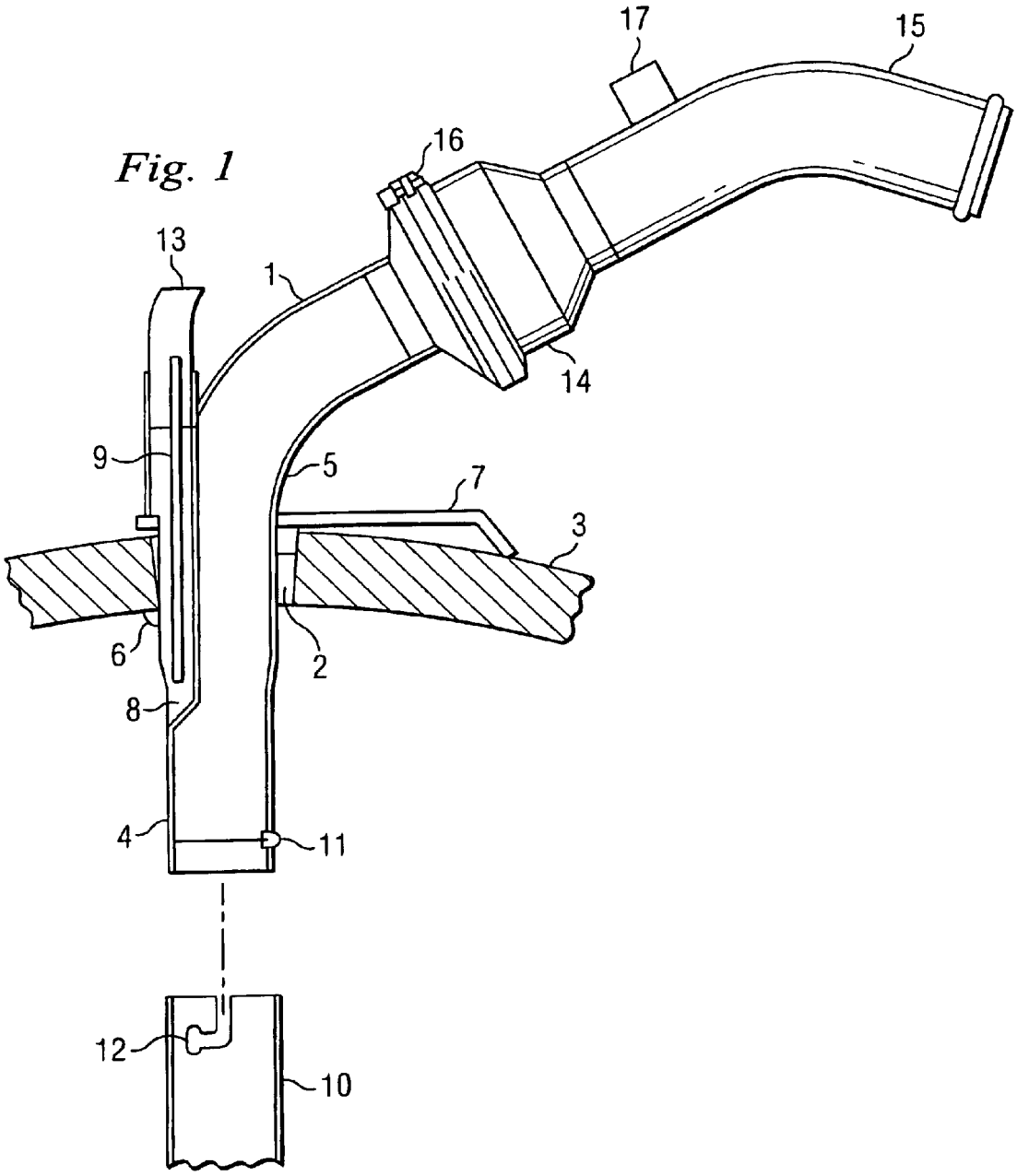
FIG. 1 is a part sectional view of a wine barrel filling apparatus.

The wine barrel filling apparatus 1 is shown inserted through a bung hole opening 2 in an oak barrel 3. The diameter of the bung hole is approximately 50 mm but the diameter may vary from barrel to barrel.

The filling apparatus 1 has a nozzle 4 which is formed from food grade stainless steel tube of external diameter 38 mm. The nozzle 4 has an arcuate section 5 with included angle of approximately 135. This angle ensures that wine in the nozzle empties into the barrel when the apparatus is being withdrawn from the barrel. Welded to the nozzle is a lug 6 which locates the nozzle at a predetermined vertical position relative to the inside surface of the barrel near the bung hole 2. On the opposite side to the lug 6, an arm 7 is welded to the nozzle 4. This arm 7 assists in maintaining the lower or downstream section of the nozzle 4 in a generally vertical position. The arm 7 also assists in locating the lug 6 on the inside surface of the barrel near the bung hole. The arm 7 is located so that the weight of the hose attached to the filling apparatus causes the lug 6 to engage against the inside surface of the barrel adjacent to the bung hole.

A section of the nozzle wall has a vertical recess 8 with a semi cylindrical shape in the lower portion of the recess. The recess 8 houses a conductivity probe 9 and by providing a recess for the probe protects the probe from damage when the nozzle 4 is inserted in a barrel. The height of the probe 9 is adjustable relative to lug 6. As well as a single conductivity probe, two, three or more probes may be used. When multiple probes are used they are set so as to be contacted by wine at different levels in the barrel allowing a number of signals to be sent to a flow regulator or flow regulators. When a single probe is used the probe output is electrically connected to a wine flow regulating valve so that when wine contacts the bottom of the conductivity probe 9 the regulating valve is closed. When multiple probes are used multiple regulating valves may be used. The use of two or more probes allows a rapid fill and slow fill operation to be combined sequentially.

This allows a barrel to be initially rapidly filled and then slowly filled for the last portion of wine. This enables barrels to be more rapidly filled than previously.

A nozzle extension 10 is able to be connected to the nozzle 4 by means of a lug 11 and lug recess 12. The nozzle extension 10 is useful for filling up the wine barrel with wine so that the wine added to the barrel is introduced at a lower level into the barrel reducing contact with oxygen. To prevent wine leakage from where the nozzle extension joins the nozzle an "O"ring seal is conveniently used. The nozzle extension may be removable, as described above, or it may form a permanent extension to the nozzle by welding. With a permanent extension the apparatus would be more suitable for filling as opposed to topping operations.

The recess 8 has an outlet 13 to allow the wine level to rise in the recess that houses the conductivity probe and also to allow electrical wires (not shown) to exit.

Alternatively the recess may continue all the way to the top and no outlets are then required. A handle portion 15, also made of 38 mm external diameter stainless steel tube, is attached to the nozzle 4 by means of flanges 16. Housed near where the handle portion joins the nozzle portion is a non-return valve 14. This valve 14 may be located either in the nozzle 14 or the handle portion 15. The non-return valve closes when the wine flow ceases by activation of an upstream solenoid valve when the wine level reaches the predetermined level. The non-return valve is typically spring actuated so that the head of wine to the upstream solenoid valve is insufficient to open the non-return valve. Other types of valves can be used including solenoid valves to achieve the desired function of not allowing wine to flow from the nozzle after the nozzle has been removed from the barrel. When a solenoid valve is used this valve may serve the function of stopping the wine flow.

However, it is generally preferred to use a separate non-return valve that does not function as the wine flow regulating valve as the weight of the solenoid valves makes lifting the nozzle more difficult. The handle portion 15 has a control button 17 located so that an operator can commence the flow of wine to the barrel. The control button is electronically connected to an upstream regulating valve (not shown) that controls the flow of wine. The wiring to the control button is not shown. Conveniently it may be housed in a suitable conduit within the wine supply hose and this is preferred to protect the electrical cabling from damage.

In operation an operator locates the wine barrel filling apparatus 1 in the bung hole 2 of an oak barrel by means of lug 6 and arm 7. The hose attached to the handle portion causes the lug to engage against the inside surface of the barrel adjacent to the bung hole. The nozzle is in a generally vertical position. The operator presses button 17 and this opens an upstream solenoid valve and allows wine to flow into the barrel. When the wine level reaches the bottom of the conductivity probe 9 the upstream solenoid valve closes. The wine flow to the apparatus ceases and the non-return valve 14 closes. This means that wine from the hose does not flow into the nozzle. This prevents spillage of wine from the nozzle after it is removed from the barrel. However, there is sufficient wine in the nozzle 4 downstream of the non-return valve 14 so that as the apparatus 1 is being withdrawn from the barrel, wine in the nozzle 4 flows into the barrel completely filling the barrel. This ability to fill the barrel completely without overfilling is important and is obtained by adjustment of the height of the conductivity probe.

The height of the conductivity probe is vertically adjustable to a predetermined position. The probe is adapted to be moved to a second higher position when the nozzle extension is used. This compensates for the additional displaced volume of the nozzle extension. The use of the filling apparatus of the present invention enables the more convenient and more rapid filling of wine barrels. It enables an increased flow rate of wine from a larger diameter hose.

It will be appreciated that the above embodiment is only illustrative.

Without being limited to the following alternative features, it is pointed out that a number of alternative embodiments may be used. For example, the conductivity probe is an example of an electronic wine level sensor means. By "electronic" we mean that mechanical actuation is not used. Other electronic level sensors include ultrasonic, hydrostatic and capacitance sensors. For example, rather than having a conductivity probe which sends a signal when wine first contacts the probe, a probe could be used so that a threshold value for resistance or capacitance could be set to cause the solenoid control valve to shut, thus controlling the wine level in the barrel. This would mean that the probe setting would be adjustable electronically rather than physically having its height changed as exemplified in the above description. A further variation is that the flow of wine could be regulated at a number of intermediate flow rates rather than simply having the flow of wine being "on" or "off". The flow rates could be reduced as the barrel filled. This may enable the more rapid filling of barrels without the danger of spillage. A further variation is that the apparatus may be dimensioned to be suitable for the topping up operation. In this situation one apparatus would be used for filling a barrel from empty and a different apparatus would be used for the topping up operation.

Since modifications within the spirit and scope of the invention may be readily effected by persons skilled in the art, it is to be understood that the invention is not limited to the particular embodiment described, by way of example, hereinabove.

What is claimed is:

1. An apparatus for filling a wine barrel through a bung hole in the top of the barrel comprising:

a nozzle for discharging wine into the barrel;

means for locating the nozzle at a predetermined vertical position relative to the inner surface of the barrel adjacent the bung hole;

a conductivity probe adapted to send a signal to an upstream flow control valve to terminate the wine flow through the nozzle and into the barrel when the wine level reaches a predetermined level in the barrel; and a valve located near the upstream end of the nozzle and adapted to close to prevent wine flowing into the nozzle from upstream of the latter valve after the wine flow is terminated.

2. The apparatus of claim 1 wherein the probe is positioned to be in contact with the wine in the barrel when the wine is at the predetermined level.

3. The apparatus of claim 1 wherein the probe is recessed into the nozzle.

4. The apparatus of claim 1 further comprising a nozzle extension adapted to engage onto the downstream end of the nozzle.

5. The apparatus of claim 1, further comprising a hollow handle member connected to the upstream end of the nozzle.

6. The apparatus of claim 1, wherein there are a plurality of flow control valves and wherein the probe is adapted to control all of the flow control valves.

7. The apparatus of claim 1, wherein the probe is recessed into the nozzle.

8. An apparatus for filling a wine barrel through a bung hole in the top of the barrel comprising:

a nozzle for discharging wine into the barrel;

a lug located on the nozzle and an arm on the opposite side of the lug for locating the nozzle at a predetermined vertical position relative to the inner surface of the barrel adjacent the bung hole;

means for sending a signal to an upstream flow control valve to terminate the wine flow through the nozzle and into the barrel when the wine level reaches a predetermined level in the barrel; and a valve located near the upstream end of the nozzle and adapted to close to prevent wine flowing into the nozzle from upstream of the latter valve after the wine flow is terminated.

9. The apparatus of claim 8, further comprising a nozzle extension adapted to engage onto the downstream end of the nozzle.

10. The apparatus of claim 8, further comprising a hollow handle member connected to the upstream end of the nozzle.

11. The apparatus of claim 8, wherein there are a plurality of flow control valves and wherein the means is adapted to control all of the flow control valves.

12. The apparatus of claim 8, wherein the means is recessed into the nozzle.

* * * * *